United States Patent [19]

Lowdenslager

[11] 4,386,351

[45] May 31, 1983

[54] METHOD AND SYSTEM FOR TWO-DIMENSIONAL TRAVELING DISPLAY AND DRIVER CIRCUITS THEREFOR

[75] Inventor: John R. Lowdenslager, Wilton, Conn.

[73] Assignee: Timex Corporation, Waterbury, Conn.

[21] Appl. No.: 218,851

[22] Filed: Dec. 20, 1980

[51] Int. Cl.[3] ..... G09G 3/28

[52] U.S. Cl. ..... 340/768; 315/169.2; 340/792; 340/800; 377/67

[58] Field of Search ..... 340/768, 792, 800; 235/92 EA, 92 SH; 307/221 C

[56] References Cited

U.S. PATENT DOCUMENTS

| | | | |
|---|---|---|---|
| 3,493,957 | 2/1970 | Brooks | 340/756 |
| 3,839,713 | 10/1974 | Urade et al. | 340/768 |
| 3,885,196 | 5/1975 | Fischer | 340/768 X |
| 3,895,372 | 7/1975 | Kaji et al. | 340/784 |
| 3,898,480 | 8/1975 | Spence et al. | 307/221 C |
| 3,953,837 | 4/1976 | Cheek | 307/221 C |
| 4,090,109 | 5/1978 | Ryan et al. | 340/792 X |
| 4,308,534 | 12/1981 | Yamamoto | 340/792 X |

FOREIGN PATENT DOCUMENTS

| | | |
|---|---|---|
| 1442580 | 7/1976 | United Kingdom . |
| 2050008 | 12/1980 | United Kingdom . |

OTHER PUBLICATIONS

R. C. Minnick; "Cutpoint Cellular Logic"; IEEE Transactions on Electronic Computers, Dec. 1964, pp. 685-698.

*Primary Examiner*—David L. Trafton

*Attorney, Agent, or Firm*—William C. Crutcher; Joseph A. Biela

[57] ABSTRACT

A two-dimensional traveling display method and apparatus for displaying data that may be continuously or intermittently changing in a manner of a traveling sign with the traveling display moving either left, right, up or down depending upon a desired format. The display comprises an electrically actuated two-dimensional dot matrix display panel formed by a plurality of rows and columns of dot-like areas whose light modifying characteristics are changed by application of electrical energization potentials. The panel is provided with respective sets of row and column electrodes for selective application of energization potentials to selected ones of the dot-like areas to form a desired image. A display matrix driver circuit comprised by a two-dimensional shift register is provided for selectively applying electrical energization potential to the row and column electrodes of the two-dimensional dot matrix display panel in accordance with data whose image is to be displayed and which is stored in the shift register. The individual cells of the shift register are applied to either the column or row electrodes of the display panel and a time division multiplexing circuit provides discrete waveform multiplexing electric signals unique to particular ones or the other of either the row or column electrodes for causing desired ones of the dot-like areas of a liquid crystal display to be energized in accordance with data whose image is to be presented and for moving the image left, right, up or down in the manner of a traveling sign.

19 Claims, 16 Drawing Figures

BACK PLANE

LIQUID CRYSTAL SOLUTION

FRONT PLANE
$V_R$
$V_m$
$V_R$
$R_1$
$R_2$
$R_3$
$R_4$
$R_5$
$C_N$
0 1 1 0 0 0 1 1 0 0
ROW 1
ROW 2
ROW 3
ROW 4
ROW 5
1/25.6 sec.
1/128 sec.

UA-10
UA-10'
R1-10
UA-9
UA-9'
UEO1
R2-9
UA-8
UA-8'
R3-8
U01
U02
UA-7
UA-7'
R4-7
UEO-2
R5-6
UA-6
UA-6'
UPPER COLUMN WAVE-FORMS
10
10'
9
9'
8
8'
7
7'
6
6'
SHIFT REGISTER CELLS
5
5'
4
4'
3
3'
2
2'
1
1'
LA-5
LA-5'
LOWER COLUMN WAVE-FORMS
R5-6
R4-7
LA-4
LA-4'
LEO2
R3-8
LA-3
LA-3'
L01
L02
R2-9
LA-2
LA-2'
R1-10
LA-1
LA-1'
LEO1
ROW SELECT WAVEFORMS
LIQUID CRYSTAL FREQUENCY

Fig. 8A
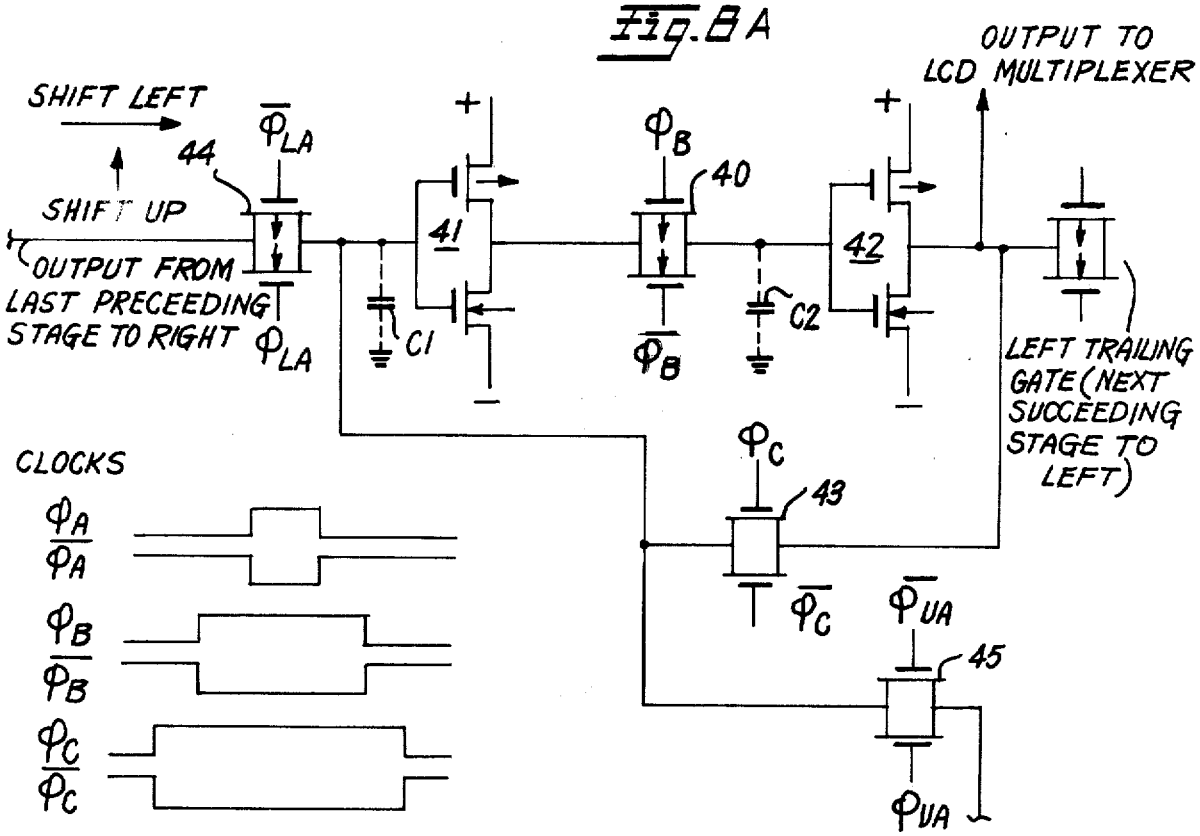
Fig. 8B
Fig. 9A
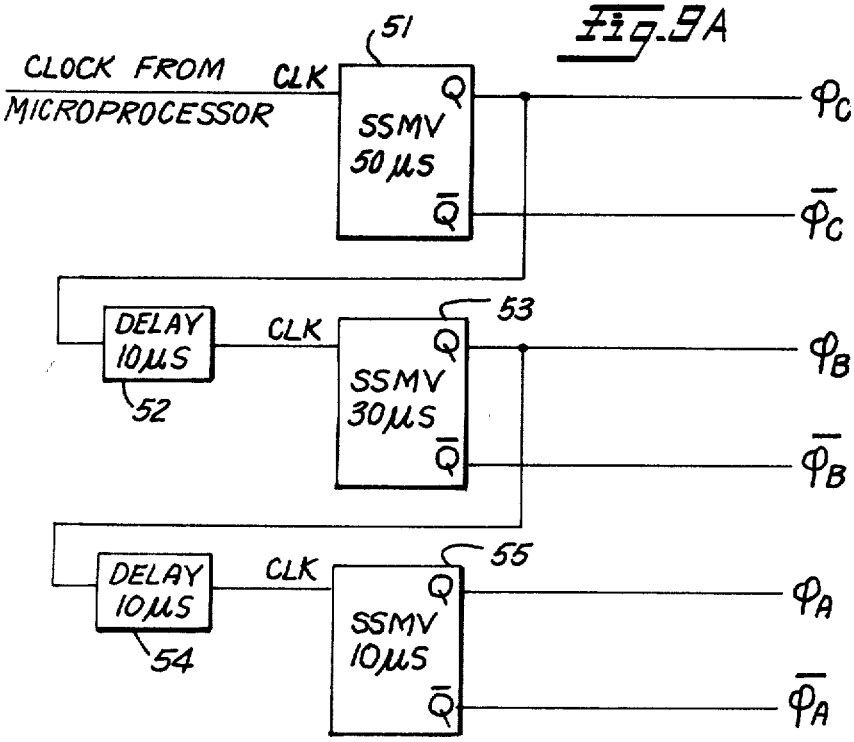
Fig. 9B
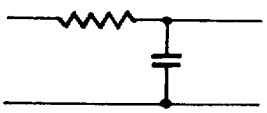
10 μ SEC. DELAY

METHOD AND SYSTEM FOR TWO-DIMENSIONAL TRAVELING DISPLAY AND DRIVER CIRCUITS THEREFOR

TECHNICAL FIELD

This invention relates to improved dot matrix liquid crystal displays (DM-LCD) suitable for use with digital watches and clocks as well as a display for microcomputers.

More specifically, the invention relates to DM-LCD's of the traveling sign type wherein the images of the characters displayed are moved either horizontally or vertically across the face of the display panel, and to an improved dot matrix display driver circuit for use in such displays.

BACKGROUND PRIOR ART PROBLEM

The prior art has made extensive use of dot matrix-liquid crystal display for a variety of purposes. Some of these uses are as a display for a pocket calculator, a general purpose data display device, a television type picture display, an oscillograph, a time display for electronic wrist watches, clocks, and the like. See, for example, U.S. Pat. No. 3,445,827—issued May 20, 1969, to R. W. Keyes for a "Memory Controlled Shift Register Display Device"; U.S. Pat. No. 3,895,372—issued July 15, 1975, to Kaji et al. for a "Quick Response Liquid Crystal Display Device"; and U.S. Pat. No. 4,127,848—issued Nov. 28, 1978to I. A. Shanks for "Liquid Crystal Wave Form Displays."

The problems encountered generally with these prior art systems involve limitations of the LCD display medium, such as limited light, limited viewing angle, the need for complex driving circuitry, and a relatively slow speed of response of the displays employed.

The advantages of a dot matrix format in a LCD is that it can provide more resolution in 17 or 16 segment numerals and alphanumeric fonts than those employed in normal liquid crystal displays. Additionally, a more pleasing, more familiar type font can be used in DM-LCD, and the characters can be made to travel across the face of the LCD panel. Known media for achieving and operating dot matrix displays include incandescent lamps, light emitting diodes (LED), and plasma electroluminescent light sources. Of these, the most familiar is the well-known "Times Square" traveling sign which uses incandescent lamps. The disadvantages of these media are the large space required, the larger power required, and the higher voltages needed to operate the displays.

U.S. Pat. No. 3,493,957—issued Feb. 3, 1970, to W. Brooks, describes a Variable Message Display where the copy appears to move across the display face. In this arrangement, each horizontal row of the display represents a line display controlled by a shift register, and at each shift command each illuminated element (incandescent lamp) appears to move one space to the left. The speed of response, driving power required, size and weight of this device precludes its use in wrist watches and microcomputers for all practical purposes. Further, the device is not capable of producing a traveling image that can be moved horizontally across the display panel and vertically up and down the panel as well.

The Elsimate® EL-8160 dot matrix pocket calculator manufactured by Sharp Co. includes a dot matrix alphanumeric LCD display in which nine discrete 5×7 alphanumeric characters are presented. The characters are separated by a space approximately two dot columns in width and the messages appear to walk across the display, but actually the clearance jump from one space to the next.

All of the above discussed prior art devices require relatively high voltages, high power, and complicated driving schemes, or like the Sharp Elsimate calculator, their displays are extremely limited in format of presentation.

Provision of a dot matrix display which is capable of moving characters smoothly in either of two dimensions, requires a great amount of driving circuitry, or conversely, a microprocessor such as the Intel 8080, with a large program and high operational speeds. As a general rule, the number of operations that a microprocessor performs during a given period of time determines the amount of power consumed by the microprocessor. For products such as wrist watches, where energy is supplied by a battery of limited capacity, this limitation becomes a major importance. For this reason, CMOS circuitry is commonly used for fabricating microprocessors. However, one characteristic of CMOS circuitry is that it is capable of operating at only a small fraction of the speed of NMOS devices such as the Intel 8080, which is a NMOS device.

As an example of the above discussed characteristics, a 7-segment digital wrist watch using a CMOS microprocessor typically operates at a relatively small duty cycle. Periodically, the CMOS microprocessor becomes active, performs a small number of operations, and turns off thereby saving battery power until it receives its next timing turn-on pulse. The more operations the microprocessor performs during each timing pulse, the more current it consumes from the battery. Unfortunately, in order to perform all of the data management and to drive the liquid crystal display for a 10×28 dot matrix capable of smoothly moving easily read and pleasing to view characters in two dimensions, requires so many operations of the microprocessor that a CMOS processor operating at normal CMOS speed cannot perform all of the necessary operations within the time periods allowed. If it could, the battery drain would be excessive. Using a NMOS or other faster microprocessor device also would require prohibitive amounts of current and thus their use is precluded in applications where batteries of limited current capacity are employed as the power source. To overcome these problems, the present invention was devised.

SUMMARY OF INVENTION

It is the substance of the present invention to remove the display maintenance function from the microprocessor and place this function on a dot matrix driver circuit which interfaces the dot matrix display panel with the microprocessor and which, under control of the microprocessor, maintains the data supplied by the microprocessor and drives the rows and columns conductors of the display panels with appropriate waveform energization potential signals in a manner such that traveling characters which are easy to read and pleasing to view, can be presented which move smoothly across the display panel either horizontally or vertically.

A further object of the invention is to provide an improved dot matrix display driver circuit for use in DM-LCD displays having the above set forth characteristics.

A feature of the invention is the provision of a two-dimensional traveling display for displaying data that may be continuously or intermittently changing in the manner of a traveling sign with the traveling display moving either left, right, up or down depending upon a desired format. The traveling display comprises an electrically actuated two-dimensional dot matrix display panel formed by a plurality of rows and columns of dot-like areas whose light modifying characteristics are changed by application of electrical energization potentials thereto and having respective sets of row and column electrodes for selective application of energization potentials to selected ones of the dotlike areas to form a desired image. Display matrix driver circuit means are provided for selectively applying electric energization potentials to the row and column electrodes and includes two-dimensional shift register means for storing data whose image is to be displayed and applying the data as control electric signals to either of said set of column electrodes or said set of row electrodes for independently controlling the electrical energization potentials applied to selected ones of the dot-like areas. Time division multiplexing circuit means also are included in the driver circuit for deriving time division multiplexing discrete waveform electric signals unique to particular ones or the other of either said set of row or said set of column electrodes for causing desired ones of the dot-like areas selectively and time sequentially to be energized in accordance with the data to be presented and for moving the image of the data thus displayed left, right, up or down across the display panel in the manner of a traveling sign. In this arrangement, shifting of data stored in the shift register out onto and across the display panel and derivation of the time division multiplexing signals is synchronized by clock signal pulses supplied from a clock signal source in a microprocessor with which the display driver circuit is employed.

A further feature of the invention is the provision of a two-dimensional shift register wherein the individual shift register stages comprising the two-dimensional shift register each have two input terminals, one for vertical shifting upon the display being operated in the vertical traveling mode and one for horizontal shifting upon the display being operated in the horizontal traveling mode. The display driver circuit further includes field shift control decoder circuit means for receiving field shift control signals from the microprocessor and deriving field shift control enabling signals for supply to the shift register stages for conditioning the shift register to shift horizontally or vertically pursuant to a desired traveling image format.

A further feature of the invention is the provision of a two-dimensional traveling display wherein the display is designed for use with a wrist watch or clock and the data to be displayed is read out on the display panel in seconds, tens of seconds, units of minutes, tens of minutes, and hours reading the display panel from right to left as viewed by an observer.

BRIEF DESCRIPTION OF DRAWINGS

The above objects, features, and many of the attendant advantages of this invention will become better understood upon a reading of the following detailed description, when considered in conjunction with the accompanying drawings, wherein like parts in each of the several figures are identified by the same reference character, and wherein:

FIG. 8A is a partial functional diagram illustrating one stage of the two-dimensional shift register illustrated partially in FIGS. 4A and 4B, as well as in FIG. 5;

FIG. 8B illustrates the waveform of a series of clock or shift signals used in shifting data to be presented through the shift register of FIG. 8A;

FIGS. 9A and 9B illustrate circuitry for use in deriving the shift pulse signals illustrated in FIG. 8B;

BEST MODE OF CARRYING OUT THE INVENTION

Figures 1A, 1B, 1C, 2:
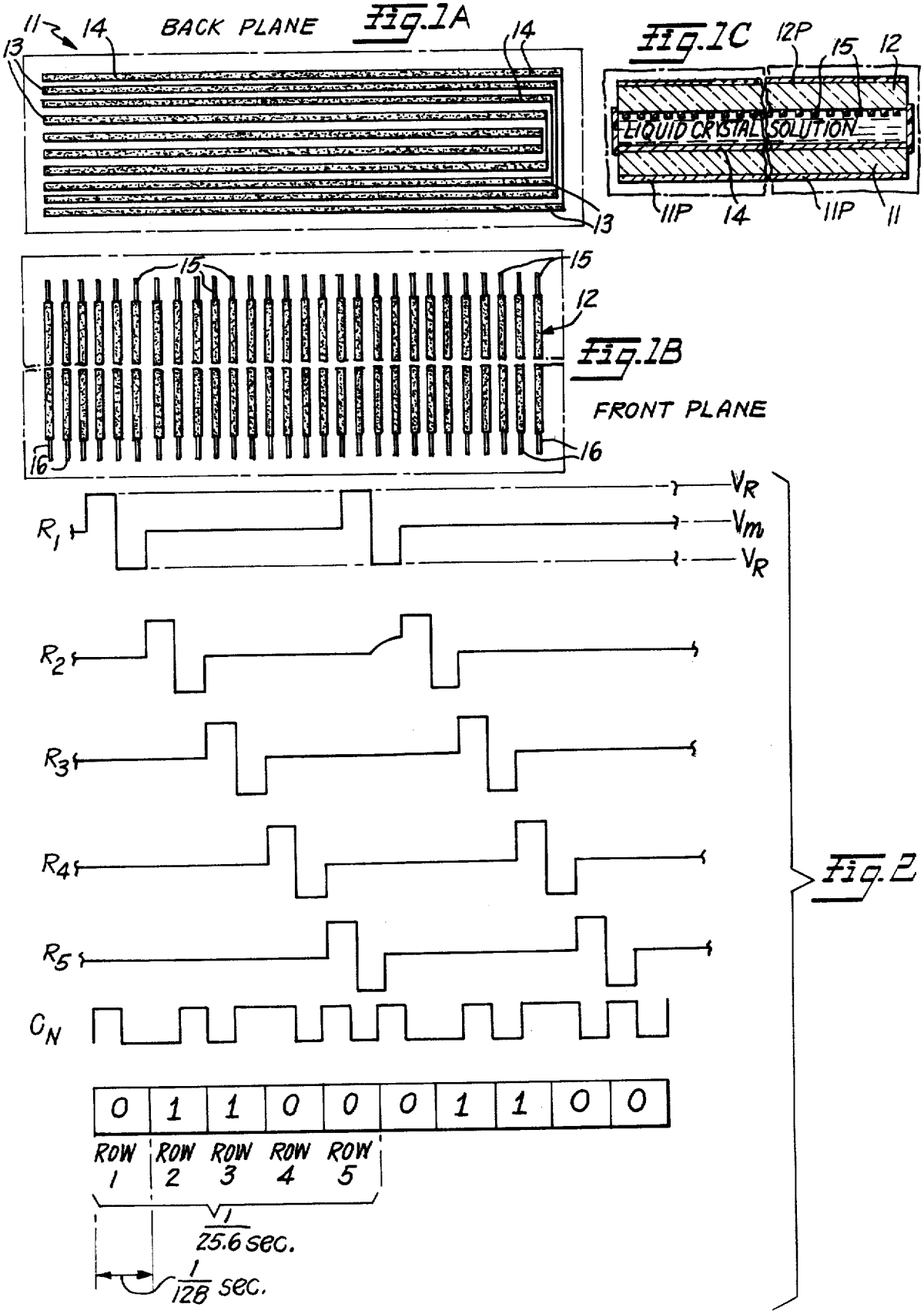
FIGS. 1A, 1B and 1C of the drawings illustrate the back plane, front plane and composite folded construction, respectively, of an LCD panel capable of providing a 10×28 dot matrix display.
FIG. 2 illustrates a series of waveforms of electrical energization potentials that are applied to the respective rows and columns of the display panel shown in FIG. 1.

One form of a dot matrix-liquid crystal display (DM-LCD) suitable for use in practising this invention is illustrated in FIGS. 1A, 1B, and 1C. FIG. 1A shows the back plane of a DM-LCD which comprises 5 rows of conductive electrodes 13 which are folded over to form 10 horizontal line electrodes 13 and 14. FIG. 1B shows the front plane of the DM-LCD and is comprised by an upper set of 28 column electrodes 15 and a lower set of 28 column electrodes 16. The two sets of electrodes are arranged such that the 28 upper column electrodes on the front plane are superimposed over the upper 5 row electrodes 13 and 14 of the back plane shown in FIG. 1A and the lower 28 column electrodes 16 on the front plane are superimposed over the lower 5 row electrodes 13 and 14 of the back plane. Thus, using 56 column electrodes and 5 rows, folded to form the 10×28 configuration, together with suitable polarizers 11P and 12P shown in FIG. 1C the resulting structure forms a 10×28 matrix or 280 uniformly spaced dot-like areas on the face of the superimposed front and back planes. The DM-LCD two-dimensional 10×28 display panel thus formed can be used as the display element in the two-dimensional traveling display described hereinafter.

The DM-LCD shown in FIGS. 1A, 1B, and 1C can be activated with appropriate waveform excitation potentials such as those shown in FIG. 2 of the drawings to cause the dot-like areas formed by the intersection of the front and back plane electrodes described in the preceding paragraph to change the light modifying characteristics of the display at the dot-like areas in the wellknown manner of liquid crystal displays. By appropriately tailoring the waveforms of the excitation signals supplied to the row and column electrodes, the RMS voltage or field produced across each dot-like area of the display can be independently controlled so as to cause that dot-like area to become either opaque or remain clear. In this manner, it is possible to display a 3×5, 4×7, 5×7 or any other size alphanumeric character. The manner in which these desired waveform electric signals are generated and applied to the DM-LCD will be described more fully hereinafter.

Figures 3, 4A, 4B:
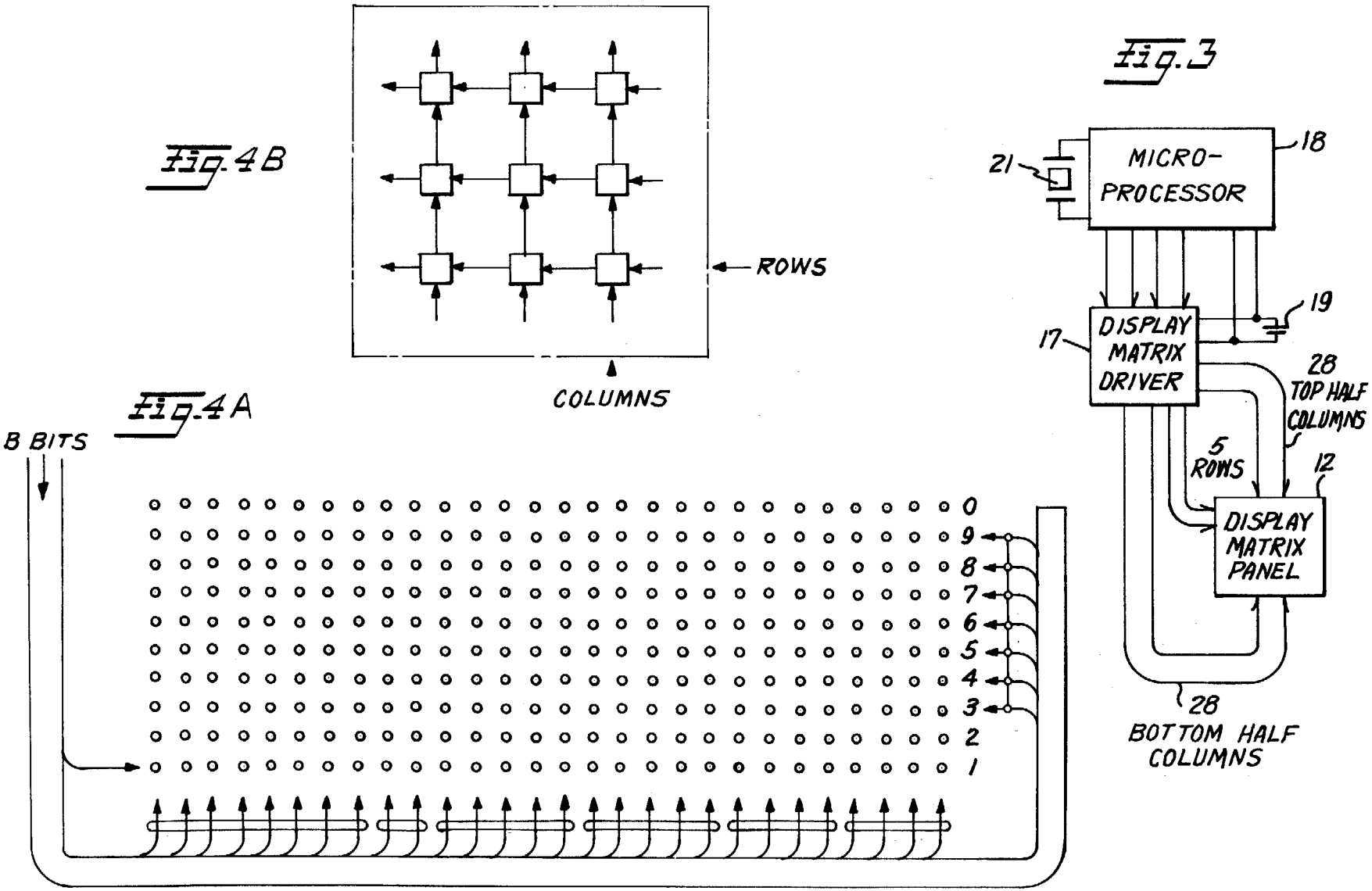
FIG. 3 is a functional block diagram of an overall two-dimensional traveling display constructed in accordance with the invention.
FIGS. 4A and 4B illustrate the layout of a two-dimensional shift register constructed according to the invention and suitable for use in a matrix driver circuit which comprises part of the invention and an important subsystem of the overall system shown in FIG. 3.

FIG. 3 is a functional block diagram of an overall two-dimensional traveling display according to the invention which is suitable for use with a liquid crystal watch. The display matrix panel for the system is shown at 12 and may be similar to that as shown and described with relation to FIGS. 1A, 1B, and 1C above. The display matrix panel 12 is driven by a display matrix driver circuit 17 which in turn is under the control of a microprocessor 18. The display matrix driver 17 will be described more fully hereinafter and the microprocessor 18 may comprise any of the known, commercially available, semiconductor integrated circuit microprocessors such as the Intel 8080 NMOS microprocessor. The microprocessor and display matrix driver circuit 17 are driven from a suitable source of electric power as the battery indicated at 19 and the microprocessor includes a clock signal source which may be crystal driven by the crystal shown at 21. Under the control of the microprocessor 18, the display matrix driver circuit 17 derives the appropriate waveform electric energization signals for application to the 28 top half column electrodes, the 28 bottom half column bottom electrodes, and the 5 row electrodes of the display matrix panel 12. The manner in which these excitation signals are derived will be described more fully hereinafter with relation to FIGS. 4 through 11. In constructing the two-dimensional display system shown in FIG. 3, it is anticipated that the microprocessor and its memory would be included in one semiconductor integrated circuit and the display driver circuit would be fabricated in a second semiconductor integrated circuit. However, for large production quantities, it is entirely feasible to fabricate both the microprocessor and its memory and the matrix driver circuit onto one semiconductor integrated circuit chip by known large scale integration fabrication techniques.

FIG. 4A is a functional diagram illustrating a preferred form of layout for a two-dimensional shift register which comprises a portion of the display matrix driver circuit 17 shown in FIG. 3. This schematic diagram is arranged to demonstrate the flow of data from the microprocessor 18 into the two-dimensional shift register, and the paths of shifting inside the shift register. It is assumed in this diagram that 8 bits of data are available from the microprocessor in one batch processing step. All, or a portion of these bits, can be shifted into the edges of the two-dimensional shift register in paths called fields. Eight of these paths through the shift register are shown in FIG. 4A, but other paths are also possible depending upon a desired display format. The preferred path shown in FIG. 4A is horizontal. With this arrangement, 7 of the data bits are conducted into the right hand edge of the two-dimensional shift register depicted in FIG. 4A into the third through ninth rows from the bottom of the shift register. With this arrangement, the 7 rows perform as 7 individual, serially coupled shift registers for shifting the data bits from right to left as viewed by the reader. As each vertical column of data reaches the left most edge of the shift register, in the course of successive shifting, the data should be no longer needed and is shifted off of the left hand edge of the shift register. The control lines for controlling shifting of the data through the register are not illustrated in FIG. 4A in order not to unduly complicate the drawing. Thus, it will be appreciated that the character patterns being displayed and shifted (traveling) through the shift register normally will reside in the 7 rows located in the third through ninth row from the bottom of the shift register. One wire of the data bus supplying the shift register is connected to the bottom row left side and the data supplied to this row is shifted to the right as a field of one row. This one row, for example, could be employed to insert decimal points.

As an alternative to the arrangement described in the preceding paragraph, under the field control of the microprocessor, as will be described hereinafter with relation to FIGS. 10A and 10B, data can be shifted into the two-dimensional shift register by inputting the data into the bottom row of each vertical column and thereafter shifting the data in vertical shift fields upwardly through the vertical columns a row at a time as depicted in FIG. 4A. When a vertical shift field is used, only those vertical columns included in the field being shifted are allowed to shift. Each column in the vertical field then will act like a serially coupled shift register. An enlarged detail of a portion of the two-dimensional shift register, showing how either shifting of the data horizontally by rows or vertically by columns is achieved, is shown in FIG. 4B. Details of construction of the individual cells of the two-dimensional shift register will be described more fully in connection with FIGS. 8A and 8B of the drawings.

Figure 5:
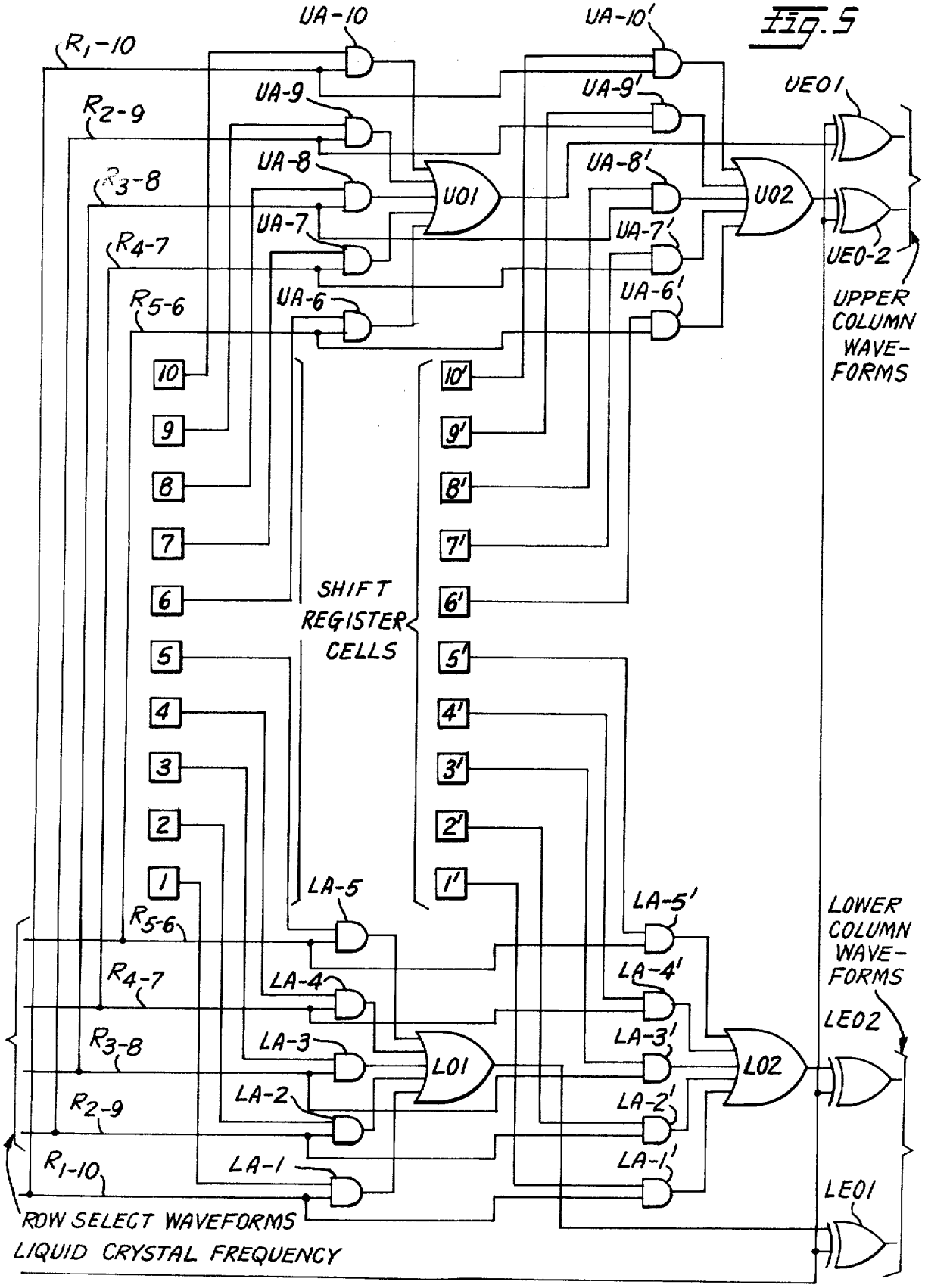
FIG. 5 is a functional block diagram which shows two columns of the shift register depicted in FIGS. 4A and 4B and illustrates the construction of the multiplexing circuitry connected to the shift register cells.
Figure 6:
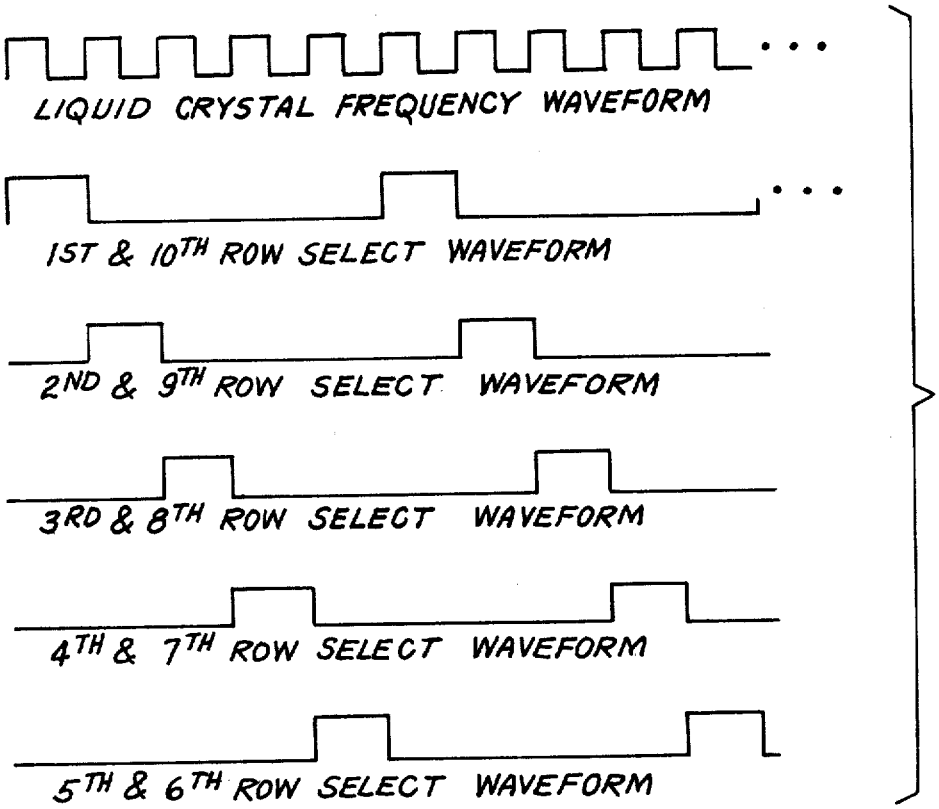
FIG. 6 is a series of electric signal waveforms which are applied as time division multiplexing signals to the inputs of the circuitry shown in FIG. 5.

FIG. 5 is a functional block diagram illustrating a portion comprising two vertical columns of the two-dimensional shift register and the associated column driver circuitry connected to the individual shift register cells comprising the two columns. The remaining 26 columns of the shift register and their associated column driver circuitry are connected in a similar fashion. As seen in FIG. 5, each of the 28 vertical columns comprise 10 shift register cells numbered 1 through 10 with the second column of shift register cells shown in FIG. 5 having a prime after their number. The lower set of 5 shift register cells have their output terminals connected as one input terminal to respective ones of 5 AND gates LA-1 through LA-5 and the upper set of shift register cells in each vertical column have their output connected to one input terminal of a set of 5 AND gates UA-6 through UA-10. The remaining input terminals of the lower and upper AND gates LA-1 through 5 and UA-6 through 10 are supplied with the time division multiplexing row circuit waveforms $R_{1-10}$, $R_{2-9}$, $R_{3-8}$, $R_{4-7}$, and $R_{5-6}$ shown in FIG. 6 of the drawings. The manner in which these row select waveform signals are derived will be described later with respect to FIGS. 6 and 7 of the drawings. The outputs from the upper and lower sets of the five AND gates are supplied through respective OR gates LO-1, LO-2, and UO-1, UO-2, etc. to respective exclusive OR gates LEO-1, LEO-2, etc. and UEO-1, UEO-2, etc.

The five row select waveform signals $R_{1-10}$ through $R_{5-6}$ are pulsed with a pulse whose duty cycle is 1/5. These signals are mutually exclusive and are derived by the circuitry shown in FIG. 7 and are supplied to the circuitry shown in FIG. 5 along with the liquid crystal frequency signal which is applied as a clock signal pulse to the remaining input terminals of the exclusive OR circuits UEO-1, UEO-2, . . . LEO-1, LEO-2. In a particular embodiment of the invention, a 128 hertz liquid crystal frequency was employed along with a row select waveform frequency of 25.6 hertz. Asynchronously with and independent of the shift register operation, the data bits of the 56 half columns of the shift register, connected as shown in FIG. 5, are sampled sequentially by an associated AND gate, such as UA6 the two inputs of which are connected respectively to the output of one of the shift register cells 6 and to one of the row select waveform signals $R_{5-6}$. The output of the AND gate enters a 5 input OR gate such as UO-1. The other 4 inputs to the OR gate are connected to the outputs of 4 similar AND gates, the inputs of which connect to the other 4 row select signals and the other 4 shift register cells in the same half column. The output of each OR circuit such as LO-1 or UO-1 is supplied as one input to the exclusive OR circuit such as UEO-1, LEO-1, etc. The other input to the exclusive OR circuits is the liquid crystal frequency clock signal whose waveform is shown as the top curve in FIG. 6. As a result of these connections, the output from each exclusive OR circuit such as LEO-1, UEO-1, etc. is a signal whose waveform is out of phase with the liquid crystal frequency when the contents of the sampled shift register cell is a logic one and otherwise is in phase when the sample shift register cell is at logic zero. The upper column waveform signals thus derived at the output of the exclusive OR gate UEO-1, UEO-2, etc. are supplied to the upper set of 28 vertically extending electrodes of the front panel shown in FIG. 1B of the liquid crystal display and the lower column waveform signals derived from the output of the exclusive OR gates LEO-1, LEO-2, etc. are supplied as the lower column waveform signals to the lower set of 28 electrodes of the liquid crystal display panel. The waveform of one of these upper or lower column waveform signals is illustrated in FIG. 2 of the drawings by the characteristic curve labled $C_N$. From this curve it will be seen that each vertical column of the shift register is time sequentially read out and the contents of the respective shift register cell in each column applied to the upper or lower electrode of the display panel in time sequence starting from row 1 or 10 through row 5 or 6. Prior to being applied to the appropriate upper or lower column electrode or the liquid crystal display panel, the output of each of the 56 exclusive OR gates UEO-1, UEO-2 . . . LEO-1, LEO-2, etc. may be supplied through a level converter which shifts the level of the signal to an appropriate value column drive voltage to form the column drive waveform shown in FIG. 2 at $C_N$; however, steps must be taken to assure that the phase relations described above are maintained.

Figure 7:
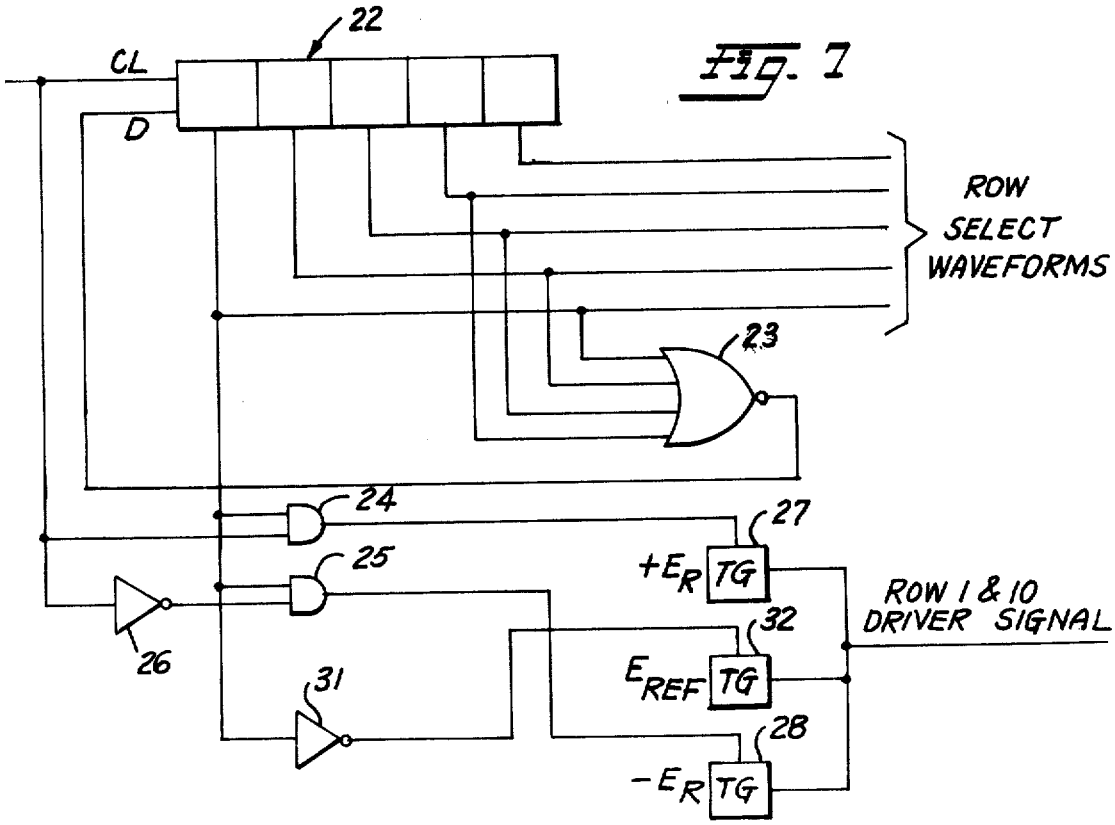
FIG. 7 is a functional block diagram of a row select wave form signal generator for use in deriving the row select wave form signals shown in FIG. 6.

FIG. 7 illustrates the construction of the row select waveform generator circuitry and the level converter circuitry for deriving the liquid crystal display panel row electrode driving voltages having the row driver waveform shown in FIG. 2 as $R_1$, $R_2$ . . . $R_5$. These row driver waveform signals shown in FIG. 2 then are applied to the row electrodes on the back panel of the liquid crystal display as shown in FIG. 1A, and are to be distinguished from the row select waveform signals from which they are derived and which are applied to the shift register cells to enable their readout as described above with relation to FIG. 5. For convenience, only the row driver circuitry for the first and tenth row waveform signal is illustrated. The other four row driver circuits are similar and hence have not been illustrated.

To generate the row select waveform signals, a 5-bit shift register shown at 22 in FIG. 7 is provided in the matrix driver circuitry and is supplied with clock signal pulses from the microprocessor at the liquid crystal frequency. These clock signals are applied to the clock input terminal of the 5-bit shift register 22 along with a data input which is serially fed to the shift register from the output of a NOR circuit 23. The output from NOR circuit 23 is high only when the logic contents of the first four states of the 5-bit shift register are all low or logic zero. Thus, shift register 22 is constrained always to contain one and only one high logic signal representative of a logic one. A logic one signal is shifted serially through the shift register 22 so that each of the 5-row select waveform signals will be produced at the output of each of the five stages, respectively, in rotation to yield the row select waveform signals shown in FIG. 6. In order to generate the respective row 1 and 10 electrode driver signals from the row 1 and 10 select waveform signal, the row 1 and 10 select waveform signal is selectively gated with the liquid crystal frequency clock signal, and with its inverse, through AND gates 24 and 25, respectively, to control transmission gates 27 and 28. These gates control the $+E_R$ and $-E_R$ voltage level. When the row select waveform is false, the inverse of the row select waveform, obtained through inverter 31, drives an $E_{REF}$ transmission gate 32 to connect the $E_{REF}$ potential level to the row 1 and 10 driver electrodes. In this manner, the row drive signals shown in FIG. 2 of the drawings are derived from the row select waveform signals.

FIG. 8A is a detailed schematic circuit diagram of a single shift register cell such as the cells numbered 1, 2, 3, etc. in FIG. 5 of the drawings. The shift register is of the type in which storage of data is achieved in a static manner but the shift of data from one shift register cell to the next is dynamic. Each shift register cell in the two-dimenisional shift register is constructed and operates in a known manner but for the fact that each cell has two inputs, one for horizontal shift and the other for vertical shift. Each shift register cell contains two CMOS-FET inverter circuits 41 and 42 of conventional known construction connected in series circuit relationship through a feedback loop that includes transmission gates 43 and 40 of conventional, known construction. With the transmission gates 43, and 40 closed (conducting) the two inverters 41 and 42 have positive feedback and can exist in two logic states. In one of the logic states, the output of the first inverter 41 is a logic zero or false and the output of the second inverter 42 is a logic one or true. In this state, the cell is said to contain a logic one. The other state for the cell is with the output of the first inverter 41 at a logic one or true level and the output of the second inverter 42 at a logic zero or false level in which state the cell is said to contain a logic zero. In the quiescient state for the cell, which is considered to be the normal state, the two input transmission gates 44 and 45 are in the open (nonconducting) condition and the two loop transmission gates 43 and 40 are closed (conducting). The transmission gate 44 connects the shift register cell to the next previous stage or cell to the right (unless the cell is in the last right hand column in which case the transmission gate 44 connects the cell to the data bus) and serves as the shift left input to the cell. The transmission gate 45 connects the input of the cell to the output from the next cell below, and serves as the shift up input to the cell.

FIG. 8B of the drawings shows a series of clock waveform shift control pulses labled $Q_A$ and its inverse $\overline{Q}_A$, $Q_B$ and its inverse $\overline{Q}_B$, and $Q_C$ and its inverse $\overline{Q}_C$ which are applied to the respective transmission gates to produce a dynamic shift of the data stored in the cell. The manner in which the shift control signal pulses are derived will be described more fully hereinafter in connection with FIG. 9A of the drawings.

In order to perform a shift left operation with the shift register cell in FIG. 8A, first the $Q_C$ and the $\overline{Q}_C$, invert the state of the cell by causing transmission gate 43 to open and cease conduction. At this point, the positive feedback loop from second stage converter 42 to first stage inverter 41 is opened, and the input to the first inverter stage 41 is allowed to float. However, the previous voltage on the small input capacitance $C_1$, of converter stage 41 retains its charge, and as a result neither stage changes state. Next, the $Q_B$ and $\overline{Q}_B$ signals are applied and cause the transmission gate 40 to open and cease to conduct. Again, however, the previous voltage on the input to the second stage converter 42 is retained by its input capacitance $C_2$, and still, neither stage changes state. Next, application of the $Q_{LA}$ and $\overline{Q}_{LA}$ signals to transmission gate 44 causes this gate to close and commence conducting. If the former logic state of the cell is the same as the output of the next cell to the right in the shift register, no change in the state of the shift register cell will take place. If, however, the cells contain opposite states, then the input capacitance $C_1$ of the first inverter stage charges to the new state of the cell to the right. As a result, the output of the first stage inverter 41 changes accordingly. At this point, the shift signals $Q_{LA}$ and $\overline{Q}_{LA}$ revert back to their former normal state, allowing the transmission gate 40 to open, and the input capacitance $C_1$ of the first inverter stage 41 again floats at its new charge or voltage level. With the cell in this condition, the shift signals $Q_B$ and $\overline{Q}_B$ revert back to their normal state and the transmission gate 40 closes and commences to conduct thereby charging $C_2$ to its new state. As a result, the output of the second inverter stage 42 assumes its new state which is the same as that represented by the voltage on the input capacitance $C_1$. Finally, signals $Q_C$ and $\overline{Q}_C$, which have the longest time duration, revert back to their normal state causing the transmission gate 43 to close and recommence conducting thereby restoring the positive feedback loop and restoring the cell to its static storage state with the new bit value, and a shift left has been achieved.

In the event that it is desired to cause the two-dimensional shift register to shift up through the vertical columns as opposed to horizontally in rows, then the shift signals $Q_{UA}$ and $\overline{Q}_{UA}$ are supplied to the transmission gate 45 thereby causing this gate to open and become conductive. This results in coupling the input of the first stage inverter 41 of the cell to the next cell below in the shift register. Here again, if the two cells are in the same state, no shift in the condition of the cell will occur. However, if the cell below is in a different state from the cell in question, then a shift in the states of the two inverters 41 and 42 will occur as described above with respect to the shift left operation. It is obvious to one skilled in the art that by appropriate interconnection of the hard leads between the various cells of the two-dimensional shift register, the shift register can be made to shift right or shift down as opposed to shifting left or shifting up.

FIG. 9A of the drawings is a functional block diagram of the circuitry included in the matrix driver circuit for generating the shift control signals shown in FIG. 8B of the drawings. Upon receipt of a clock signal pulse from the microprocessor, a 50 microsecond single shot multivibrator 51 of conventional, commercially available, semiconductor integrated circuit construction, generates a $Q_C$ and a $\overline{Q}_C$ signal at the two output terminals thereof for a period of 50 microseconds. The $Q_C$ output signal is supplied through a 10 microsecond delay circuit 52 shown in FIG. 9B of the drawings to the clock input terminal of a 30 microsecond single shot multivibrator circuit 53 of conventional construction which derives the two shift control signals $Q_B$ and $\overline{Q}_B$ at its output terminals. The $Q_B$ output of multivibrator 53 then is supplied through a second 10 microsecond delay circuit 54 to the clock input terminal of a 10 microsecond single shot multivibrator 54 which derives the $Q_A$ and $\overline{Q}_A$ shift control signals.

Figures 10A, 10B, 11:
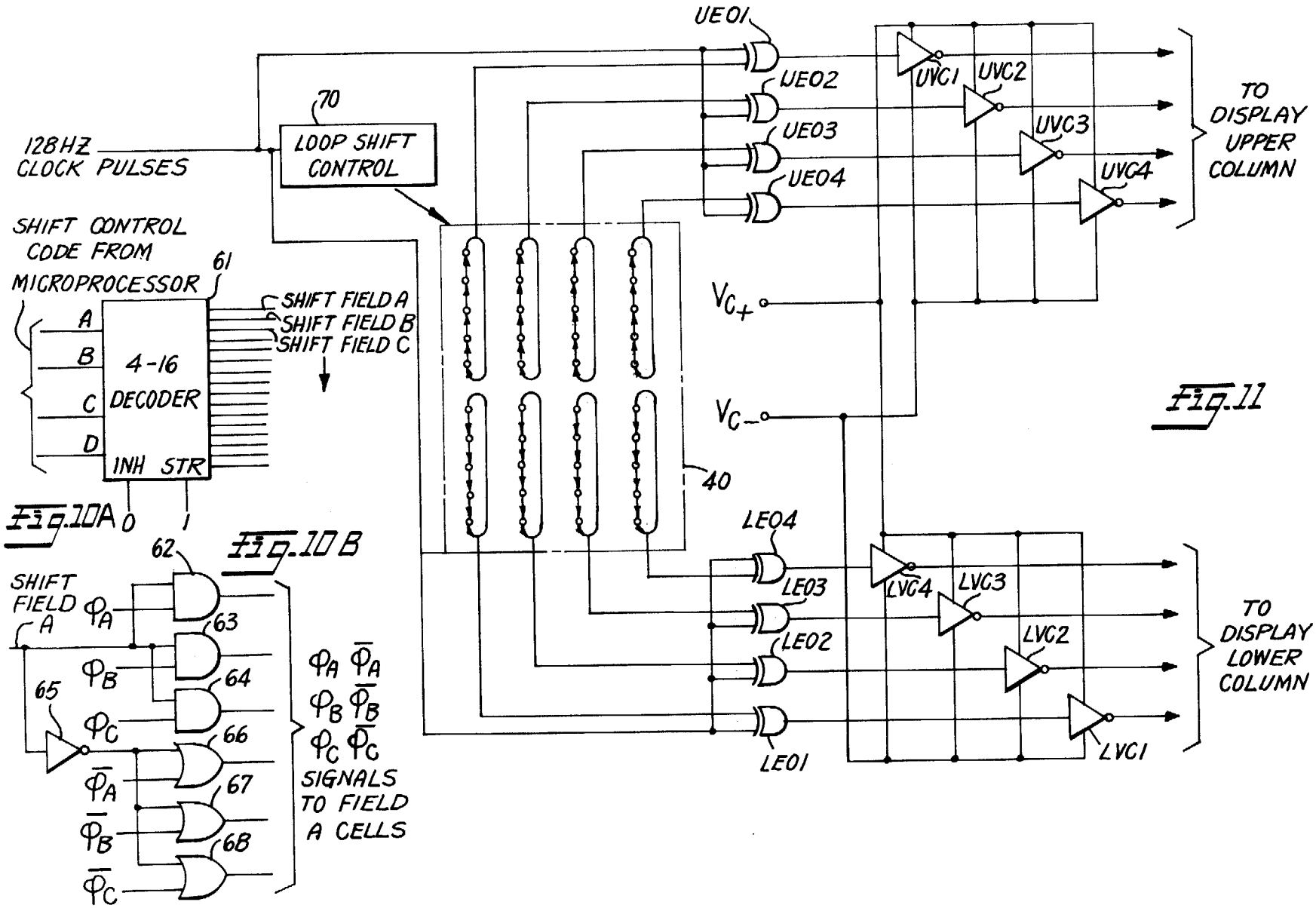
FIG. 10A illustrates the nature of a field control decoder circuit employed in deriving field control signals for application to the two-dimensional shift register to control the dimension in which data being displayed travels whether horizontally or vertically.
FIG. 10B illustrates a shift pulse routing circuit for routing the output from the decoder of FIG. 10A to control appropriate operation of the cells in the two-dimensional shift register.
FIG. 11 is a functional block diagram showing an alternative multiplex type of shifting control for controlling the shifting of data through the two-dimensional shift register.

In order to control the direction in which data is shifted through the two-dimensional shift register, whether vertically or horizontally, the shift control pulses supplied from the FIG. 9A circuitry are processed through suitable AND gate circuitry under the control of a control signal decoder 61 shown in FIG. 10A of the drawings. The decoder 61 may comprise a conventional, commercially available, semiconductor integrated circuit decoder such as the AY-16 line decoder or the RCA 4514 decoder. The decoder 61 receives shift control code pulses from the microprocessor and from these code pulses derives an output field shift control signal indicated as shift field A, shift field B, etc. according to which field is to be shifted. These shift field control signals then are routed through transmission gates to the appropriate shift cells as described earlier with relation to FIG. 8A. The shift field signal, such as drift field A, enables 3 AND gates 62, 63, and 64 directly and through an inverter 65 enables 3 inverted AND gates 66, 67, and 68. The remaining input terminals of the AND gates 62, 63, and 64 have the $Q_A$, $Q_B$, and $Q_C$ shift control signals applied thereto so that these signals are supplied directly to the corresponding transmission gates of the shift register cells for field A, assumed to be a horizontal left to right shifting row by row. The inversely enabled inverted AND gates 66, 67, and 68 have the $\overline{Q}_A$, $\overline{Q}_B$ and $\overline{Q}_C$ signals applied to their remaining input terminals, respectively, to derive at their outputs the required shift signals for application to the respective cells of the two-dimensional shift register.

FIG. 11 is a functional block diagram of alternative circuitry for accomplishing multiplexing out of the data stored in the two-dimensional shift register 40 in place of the rather complex network of AND gates and OR circuits described with relation to FIG. 5. In the embodiment of the invention shown in FIG. 11, alternate shift paths are provided in the shift register to loop each of the 56 half columns of 5 shift register cells within the shift register by means of a loop shift control circuit 70. Shift pulses are supplied to each of these loops at the 128 hertz liquid crystal frequency clock pulse rate from the microprocessor via the loop shift control circuitry 70. With this arrangement, during each cycle of the liquid crystal frequency clock pulses, the data stored in the next half column to be sampled during multiplexing, is made available by the provision of a feedback connection of the 5-bit shift register loops, respectively. Each of these loops then are connected to the respective exclusive OR circuits UEO-1, UEO-2 . . . and LEO-1, LEO-2, etc. described previously in connection with FIG. 5 which generates the desired matrix column drive waveform signals. The output signals from the exclusive OR circuits are processed through level shifting converters of conventional construction shown at LVC-1, LVC-2 . . . UVC-1, UVC-2, etc. for raising the voltage level of the signal to a value required to assure proper operation of the DM-LCD panel. By this arrangement, some simplification of the circuitry built into the matrix display driver circuit can be achieved.

From the foregoing description, it has been shown how data to be displayed is shifted, either a row or a column at a time, through a two-dimensional shift register, and how this data, in bits, is multiplexed out of the shift register and displayed. It will be appreciated by those skilled in the art that the pattern or image stored by the data in the shift register is the image of the pattern displayed on the DM-LCD. Further, as the image in the shift register is shifted up or left at a rate, say, of 8 lines or rows per second, the image shown on the display panel also will be perceived by the viewer to move across the display panel in a smooth manner. In particular, if on each shift one column of a new character is shifted into the shift register, on successive shift pulses, that character will appear on the right hand side of the display as the characters previously written move smoothly to the left, not unlike the display of alphanumeric characters by the "Times Square" moving sign. If, on the other hand, the rows of an alphanumeric characters are written into the vertical shift field of, say, four columns on the right hand edge of the display, the characters previously written will shift up smoothly and off the face of the display panel as each new digit takes the place of the old, not unlike the operation of the trip mileage counter of an automobile odometer. In such an arrangement, the vertical shift fields can be made to coincide with the digits of a six-digit timepiece, showing, respectively from right to left, seconds, tens of seconds, units of minutes, tens of minutes, hours. The microprocessor can then be programmed to maintain and increment the values of the digits thus displayed and supply inputs to the display driver circuit at relatively long intervals, say, one-eighth of a second. Thus it will be appreciated that the duty cycle on the microprocessor has been greatly reduced since the display maintenance function has been assumed by the two dimensional shift register; and, hence, it is possible to provide an inexpensive, low-cost timekeeping module exhibiting superior appearance and interest to the user.

The terms "two-dimension", "rows", and "columns" as used herein while specifically describing a dot matrix using segments in X and Y orientation does not preclude use of the invention in a dot matrix arranged in a different manner such as polar coordinates, for example. In such case the back plane of the display would comprise arcuate sectors and the front plane would comprise radial segments emanating from one center. The same type of two dimensional shift register means and waveforms would be employed, and the display could shift radially in and out as well as rotary about a center.

Having described one embodiment and a variation thereto of a new and improved method and system for two-dimensional traveling displays and driver circuits therefore, other modifications, variations, and additions to the invention will be suggested to those skilled in the art in the light of the above teachings. It is therefore to be understood that any such obvious changes are considered to come within the scope of the invention as defined by the appended claims.

What is claimed is:

1. A two-dimensional traveling display for displaying data that may be continuously or intermittently changing in the manner of a traveling sign with the traveling display moving either left, right, up or down depending upon a desired format; said traveling display comprising an electrically actuated two-dimensional dot matrix display panel formed by a plurality of rows and columns of dot-like areas whose light modifying characteristics are changed by application of electrical energization potentials thereto and having respective sets of row and column electrodes for selective application of energization potentials to selected ones of the dot-like areas to form a desired image, display matrix driver circuit means for selectively applying electrical energization potentials to the row and column electrodes of said two-dimensional dot matrix display panel in accordance with the image to be displayed, said display matrix driver circuit means including two-dimensional shift register means for storing data whose image is to be displayed and applying the data as control electric signals to either said set of column electrodes or said set of row electrodes for independently controlling the electrical energization potentials applied to selected ones of the dot-like areas, and time division multiplexing circuit means providing discrete signals unique to particular ones or the other of either said set of row or said set of column electrodes for causing desired ones of the dot-like areas selectively and time sequentially to be energized in accordance with the data to be presented and for moving the image of the data thus displayed left, right, up or down across the display panel in the manner of a traveling sign.

2. A two-dimensional traveling display according to claim 1 wherein shifting of data stored in the shift register out onto and across the display panel and derivation of said time division multiplexing signals is synchronized by clock signal pulses supplied from a clock signal source.

3. A two-dimensional traveling display according to claim 2 wherein the individual shift register stages comprising the two-dimensional shift register means each have two input terminals, one for vertical shifting upon the display being operated in the vertical traveling mode and one for horizontal shifting upon the display being operated in the horizontal traveling mode.

4. A two-dimensional traveling display according to claim 3 wherein the two-dimensional shift register means comprises a plurality of binary storage cells arranged in an array in respective rows and columns with each cell having two stable states of operation representative of a binary one or a binary zero, respectively, a plurality of transmission gates which may be turned-on (opened) or turned-off (closed) to selectively interconnect the respective data storage cells together to form shift register stages, each of said data storage cells having respective sets of horizontally arrayed transmission gates on each side thereof for electrically interconnecting the data storage cells in each horizontal row of the array into a serially coupled shift register stage with all of the horizontal rows forming a plurality of parallel horizontal rows of series coupled shift register stages, and each of the data storage cells also having respective vertically arrayed transmission gates on the lower and upper sides thereof for electrically interconnecting the data storage cells in each vertical column of the array into a serially coupled shift register stage with all the vertical columns of the array forming a plurality of parallel vertical columns of series coupled shift register stages, whereby data to be stored may be inputed at one end of each horizontal shift register row and shifted right or left through the two-dimensional shift register or alternatively the data to be displayed may be inputed at one end of each vertical column and shifted up or down through the two-dimensional shift register.

5. A two-dimensional traveling display according to claim 3 further including field shift control decoder circuit means for receiving field shift control signals from a controller and deriving field shift control enabling signals for supply to the shift register stages for conditioning the shift register means to shift horizontally or vertically pursuant to a desired traveling image format.

6. A two-dimensional traveling display according to claim 1 further including a microprocessor for supplying the data to be displayed and controlling operation of the display matrix driver circuit means.

7. A two-dimensional traveling display according to claim 5 further comprising a microprocessor for supplying the data signals to be displayed to said display matrix driver circuit means, said microprocessor including a clock signal pulse source for supplying the clock signal pulses for synchronizing operation of said display matrix driver circuit means and said time division multiplexing circuit means and further including means for supplying field shift control signals to said field shift control decoder circuit means.

8. A two-dimensional traveling display according to either claim 1 or 7 wherein the display is designed for use with a wrist watch or clock and the data is read-out on the display panel in seconds, tens of seconds, units of minutes, tens of minutes and hours reading the display panel from right to left as viewed by an observer.

9. A two-dimensional traveling display according to either claim 1 or claim 7 wherein the display is designed for use as the display for a microcomputer.

10. A two-dimensional traveling display according to either claim 1 or claim 7 wherein said display matrix driver circuit means, said shift register means, said time division multiplexing circuit means and said microprocessor all comprise semiconductor integrated circuits.

11. A display matrix driver circuit for selectively applying electrical energization potentials to the row and column electrodes of a two-dimensional dot matrix panel in accordance with an image to be displayed; said display matrix driver circuit including two-dimensional shift register means for storing data whose image is to be displayed and applying the data as control electric signals selectively to either a set of column electrodes or a set of row electrodes of a two dimensional dot matrix display panel for independently controlling the electrical energization potentials applied to respective ones of the dot-like areas of the display panel whereby an image is presented, and time division multiplexing circuit means coupled to and controlling said two dimensional shift register means for selectively deriving and applying discrete waveform multiplexing electric signals unique to particular ones or the other of either said set of row electrodes or said set of column electrodes for causing desired ones of the dot-like areas of a display panel to be selectively and time sequentially energized in accordance with the data to be presented and for moving the image of the data thus displayed left, right, up or down across a display panel in the manner of a traveling sign.

12. A display matrix driver circuit according to claim 11 wherein shifting of data stored in the shift register out onto and across the display panel and derivation of said time division multiplexing signals is synchronized by clock signal pulses supplied from a clock signal source.

13. A display matrix driver circuit according to claim 12 wherein the individual shift register stages comprising the two-dimensional shift register means each is of the type in which storage of data is achieved in a static manner but to shift data from one shift register cell to another is dynamic and each have two input terminals, one for vertical shifting upon the display being operated in the vertical traveling mode and one for horizontal shifting upon the display being operated in the horizontal traveling mode.

14. A display matrix driver circuit according to claim 13 further including field shift control decoder circuit means for receiving field shift control signals from a controller and deriving field shift control enabling signals for supply to the shift register stages for conditioning the shift register means to shift horizontally or vertically pursuant to a desired traveling image format.

15. A display matrix driver circuit according to claim 12 further including a microprocessor for supplying the data to be displayed and clock signal pulses for controlling operation of the display matrix driver circuit means.

16. A display matrix driver circuit according to claim 14 further comprising a microprocessor for supplying the data signals to be displayed to said display matrix driver circuit means, said microprocessor including a clock signal pulse source for supplying the clock signal pulses for synchronizing operation of said display matrix driver circuit means and said time division multiplexing circuit means and further including means for supplying field shift control signals to said field shift control decoder circuit means.

17. A display matrix driver circuit according to either claim 11, 15, or 16 wherein said display matrix driver circuit, said shift register means, said time division multiplexing circuit means and said microprocessor all comprise semiconductor integrated circuits.

18. The method of operating a traveling display in two dimensions for displaying data that may be continuously or intermittently changing in the manner of a traveling sign with the traveling display moving either left, right, up or down in accordance with a desired format; said method employing an electrically actuated two-dimensional dot matrix display panel formed by a plurality of rows and columns of dot-like areas whose light modifying characteristics are changed by application of electrical energization potentials thereto and having respective sets of row and column electrodes for selective application of energization potentials to selected ones of the dot-like areas to form a desired image, and display matrix driver circuit means including a two-dimensional shift register; said method comprising applying the data signals stored in the two-dimensional shift register to either the set of column electrodes or the set of row electrodes of the two-dimensional display panel as control electric signals for individually controlling the electric energization potentials applied to selected ones of the dot-like areas of the display panel, and applying time division multiplexing discrete waveform electric signals unique to particular ones of the other of either said set of row electrodes or said set of column electrodes for causing selected ones of the dot-like areas of the display panel selectively and time sequentially to be energized in accordance with the data to be presented and for moving the image of the data thus displayed either left, right, up or down in the manner of a traveling sign.

19. A two-dimensional shift register comprising a plurality of binary data storage cells arranged in an array in respective rows and columns with each cell having two stable states of operation representative of a binary one or a binary zero, respectively, a plurality of transmission gates which may be turned-on (opened) or turned-off (closed) to selectively interconnect the respective data storage cells together to form shift register stages, each of said data storage cells having respective sets of horizontally arrayed transmission gates on each side thereof for electrically interconnecting the data storage cells in each horizontal row of the array into a serially coupled shift register stage with all of the horizontal rows forming a plurality of parallel horizontal rows of series coupled shift register stages, and each of the data storage cells also having respective vertically arrayed transmission gates on the lower and upper sides thereof for electrically interconnecting the data storage cells in each vertical column of the array into a serially coupled shift register stage with all the vertical columns of the array forming a plurality of parallel vertical columns of series coupled shift register stages, whereby data to be stored may be inputed at one end of each horizontal shift register row and shifted right or left through the two dimensional shift register or alternatively the data to be displayed may be inputed at one end of each vertical column and shifted up or down through the two-dimensional shift register.

* * * * *